US006309263B1

(12) United States Patent
Mier-Maza

(10) Patent No.: US 6,309,263 B1
(45) Date of Patent: Oct. 30, 2001

(54) BICYCLE-TYPE MARINE VESSEL

(76) Inventor: Rafael Mier-Maza, Mariano Matamoros #36-9, Queretaro, Qro 76139 (MX)

( * ) Notice: Subject to any disclaimer, the term of this patent is extended or adjusted under 35 U.S.C. 154(b) by 0 days.

(21) Appl. No.: 09/598,430

(22) Filed: Jun. 22, 2000

(51) Int. Cl.[7] ..... B63H 16/20
(52) U.S. Cl. ..... 440/30; 440/21
(58) Field of Search ..... 440/21, 25, 26, 440/27, 29, 30, 31, 32

(56) References Cited

U.S. PATENT DOCUMENTS

| | | | | |
|---|---|---|---|---|
| 839,476 | * | 12/1906 | Harlett | 440/30 |
| 2,910,035 | * | 10/1959 | Johnson | 440/30 |
| 4,459,116 | * | 7/1984 | Moore | 440/21 |
| 4,795,381 | * | 1/1989 | Willems | 440/21 |
| 5,362,264 | * | 11/1994 | Parant | 440/30 |
| 5,722,865 | * | 3/1998 | Tatum | 440/30 |
| 5,807,148 | * | 9/1998 | Siviero | 440/30 |

* cited by examiner

*Primary Examiner*—Stephen Avila
(74) *Attorney, Agent, or Firm*—Harrison & Egbert

(57) ABSTRACT

A bicycle-type marine vessel including a long, narrow hull unstable in nature, that keeps balance on the water by means of a front rotating keel-propeller system that plays the role of a front wheel on a ground bicycle. The forward location of the keel and propeller permit the operator, sitting on a ground bike type frame, to balance and direct the vessel, while in motion, by means of the handlebar and body leaning. Forward impulse is achieved by leg actuated pedals that transmit power to the propeller placed at the back of the forward turning keel. The balancing force comes from the course change of the hull given by the new keel and propeller direction.

11 Claims, 8 Drawing Sheets

BICYCLE-TYPE MARINE VESSEL

BACKGROUND OF THE INVENTION

1. Field of the Invention

The present invention deals with a human powered aquatic craft. It has to do with an aquatic vessel capable of moving over the water at very high speeds due to a very narrow and long hull that is driven by human leg power applied on pedals that transmit it to a propeller placed well forward of the hull, at the back of a free turning keel. Such directionable keel and propeller, placed near the hull bow, give enough turning power to redirect the vessel and to maintain the crafts balance, eliminating the need of a rudder and many associated parts, and making it natural and logical to use by any ground bike rider.

2. Description of the Related Art

Most all pedal driven watercraft up to recent dates are heavy and slow. The reason is that the wide flat bottom is needed to stay upright. This necessitates using a large wetted surface which slows the vessel, restricting the usage of pedal boats to easy going recreational activities in flat, calm, close water areas. To overcome this, catamaran type pedal driven vessels have been developed. The two pontoons give enough width for stability with lower wetting surface and therefore somewhat higher speeds, but still lower speeds as compared to a single narrow hull. Both types of vessels are hard to handle in choppy waters in bad weather because they tend to capsize with medium to large swells.

Recently a canard balanced water bicycle, consisting of: narrow mono-hull, bicycle frame, pedal driven back propeller, direction stern rudder and movable canard under the hull at about mid-ship was introduced.

This water bicycle turned out to be the fastest long range human powered vehicle because of its long narrow hull. It can work on open water because of its round shaped hull and its balance with the underwater canard. Unfortunately it turned out to be too complex, too heavy, with many parts, hard to maintain, non user friendly and very expensive. This is so because it uses the deep moving canard for balance, a stern rudder activated by cables with brake levers on the handlebars, a gear system that moves a shaft that passes through the hull and a back stainless steel flexible support to keep the propeller and shaft in place.

Another disadvantage is the draft. The keel, the rudder and the propeller are so deep that it is impossible to move around shallow water or fishing nets, and make it unfeasible to land on shallow shores.

The biggest disadvantage though is the counteracting forces that the canard, or moving keel and the rudder create. When in motion, the canard being very close to the center of buoyancy and/or the center of mass, gives a strong restoring force when turned by a small angle. On the other hand, the rudder at the stern, when used to turn by means of the brake handles creates a tilting or falling force on the hull rider system. Therefore the rider must apply additional restoring force with the canard to compensate for the tilting force of the rudder when an-attempt to change course is made.

This unnatural behavior doesn't resemble that of making a turn with a ground bicycle and wastes useful energy, especially on races where optimum use of it is wanted. The energy loss comes from the drag the two foils create when one is turning while the other is keeping hull balance. This adds to the weird feeling of a seasoned cyclist that uses the brake handles to turn instead of stopping and the handlebar to stay vertical instead of turning.

Therefore, none of the prior boats have a system as simple and reliable as that of a ground bicycle to turn and keep balance, using only the handlebar, while at slow or fast motion.

In order to understand what is meant by bicycle-type, a little analysis of the ground forces is in order, A ground bicycle (gb) rider, when at very low speed, like when waiting for the green light, usually stays upright by means of handlebar turnings from one side to the other and short pedal pushes.

Basically when balance is lost to one side, the handlebar is turned to the same side a long with slight pedal push and balance is restored by a short displacement of the bike towards the resultant direction of fall. Immediately the rider straightens up and prepares himself to react in the direction where balance gets lost again, until the green light turns on and he can speed up and profit from the wheels gyroscopic effect for easier balance. It is important to emphasize that primarily the balance comes from the slow motion dynamics explained before and the fast speed gyroscopic effect is only additional help.

Now let's look at the dynamics of this slow motion balance. FIGS. 1, 2 and 3 show the speed and force vectors acting on the rider.

In these figures the arrows are:

A is the forward momentum

B is the falling trend

C is the opposition of the ground to the tilted tire or the opposition of the water to the tilted keel.

D is the rider forward momentum when the tire or keel is tilted

E is the resultant motion due to falling trend B and forward trend D

F is the restoring trend due to the canard action against the water

G is the falling trend due to the rudder action against the water

FIG. 1 represents a ground bicycle. In 1*a*) the rider loses balance to the left. In 1*b*) he turns to the left. The ground presents an opposition to continue to go forward. The rider momentum (D) tends to continue in the forward direction (Newtons first law). The resultant rider's motion is towards the left and forward (E). On the other hand the easy direction for the front tire that is being pushed by the pedal power is towards the front left (E). In 1*c*) the rider reaches balance again. In 1*d*) the cycle starts again, but this time to the right side.

The stronger the fail seems, the bigger the handlebar turning in order to balance in the new direction the momentum forward trend with the gravity falling trend.

In the previous art, in FIG. 2*a*), the canard balanced water craft restores balance by turning the handlebar and therefore the canard 2*b*), and opposing resistance to the oncoming water on one side, creating an immediate restoring torque (F) as can be seen in FIG. 2*b*), with almost no directional or course change, since the canard stands very lose to the center of mass.

The bigger the canard tilting, the larger the restoring force.

The big disadvantage comes with the aft rudder as can be seen in FIG. 2*b*. Changing course creates a falling force (G) that tends to flip the hull. Extra canard compensation (F) is needed in order to avoid falling, increasing water drag. Another means to counteract the fall is to lean the body towards the opposite side of the turn, contrary to the behavior on a ground bicycle.

The bicycle-type marine vessel is shown in FIG. 3. The resemblance to a ground bicycle is apparent. The rider turns the handlebar when balance is lost and the keel-propeller system powers the boat in the new direction. The water opposes the forward motion (C), the easy direction is (E), which is also the resultant direction (E) of fall trend (B) and forward momentum trend (D). The rider reaches balance 3*c*) and the cycle starts again 3*d*).

If the rider wants to make a turn, he leans the body towards the turning side, and tilts the forward keel-propeller towards the new direction and balance is restored when the hull turns just like in a ground bicycle.

BRIEF SUMMARY OF THE INVENTION

Instead of heavy flat hulls, double hull or single hull water crafts that suffer from inefficiency in order to stay upright, the present invention is directed to a forward movable keel system that keeps its balance based on the same principle as ground bicycles at low speed. This permits a very fast, thin, natural to use water vessel, with fewer moving parts. It also permits efficient close turns and allows maneuverability in waves, access to shallow waters and seaworthiness.

The forward movable keel and propeller system in combination with body leaning open a new way to approach balance in waves and surfing. The strong underwater force of the turned keel and propeller allows for balance restoration even when the rider has reached high levels of inclination, permitting quick turns to face incoming waves and to compensate for side tilting waves. The forward movable keel and propeller system eliminates the need for a back rudder, pintols, gudgeons, stainless steel cables encased in teflon guides, high leverage brake handles, etc.

The forward movable keel may be so small due to the system keel-propeller high-efficiency restoring power , and being the only under-hull piece, it allows approaching to very shallow waters as low as 50 cms from the waterline.

The bicycle-type marine vessel can be used for exercise, for bicycling away from roads and cars, for wave acrobatics and to travel very long distances. It can sustain speeds in the order of 14–16 km/hr, can reach peaks of 23–26 km/hr and can negotiate 25–33 km in open sea in 2–3 hours.

Advantages and further objects of the present invention will become apparent with the analysis and description of the following drawings.

BRIEF DESCRIPTION OF THE SEVERAL VIEWS OF THE DRAWINGS

The following drawings are only descriptive of one way to accomplish the product of this invention and must not be considered as unique or limiting. It is possible for other arrangements that achieve the same goal and that are meant to operate on the same principles and under the same ideas.

DETAILED DESCRIPTION OF THE INVENTION

Figures 1A, 1B, 1C, 1D:
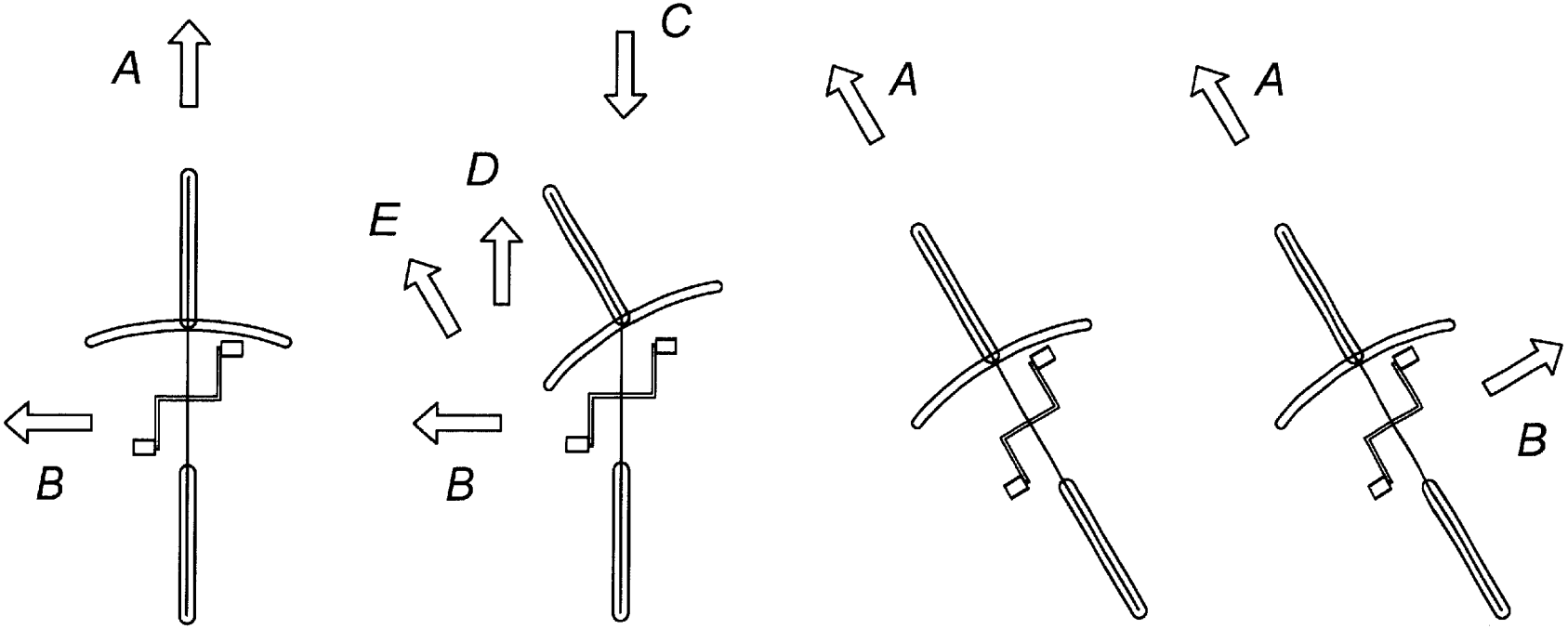
FIG. 1 is an illustration of forces on a ground bicycle.
Figure 2A:
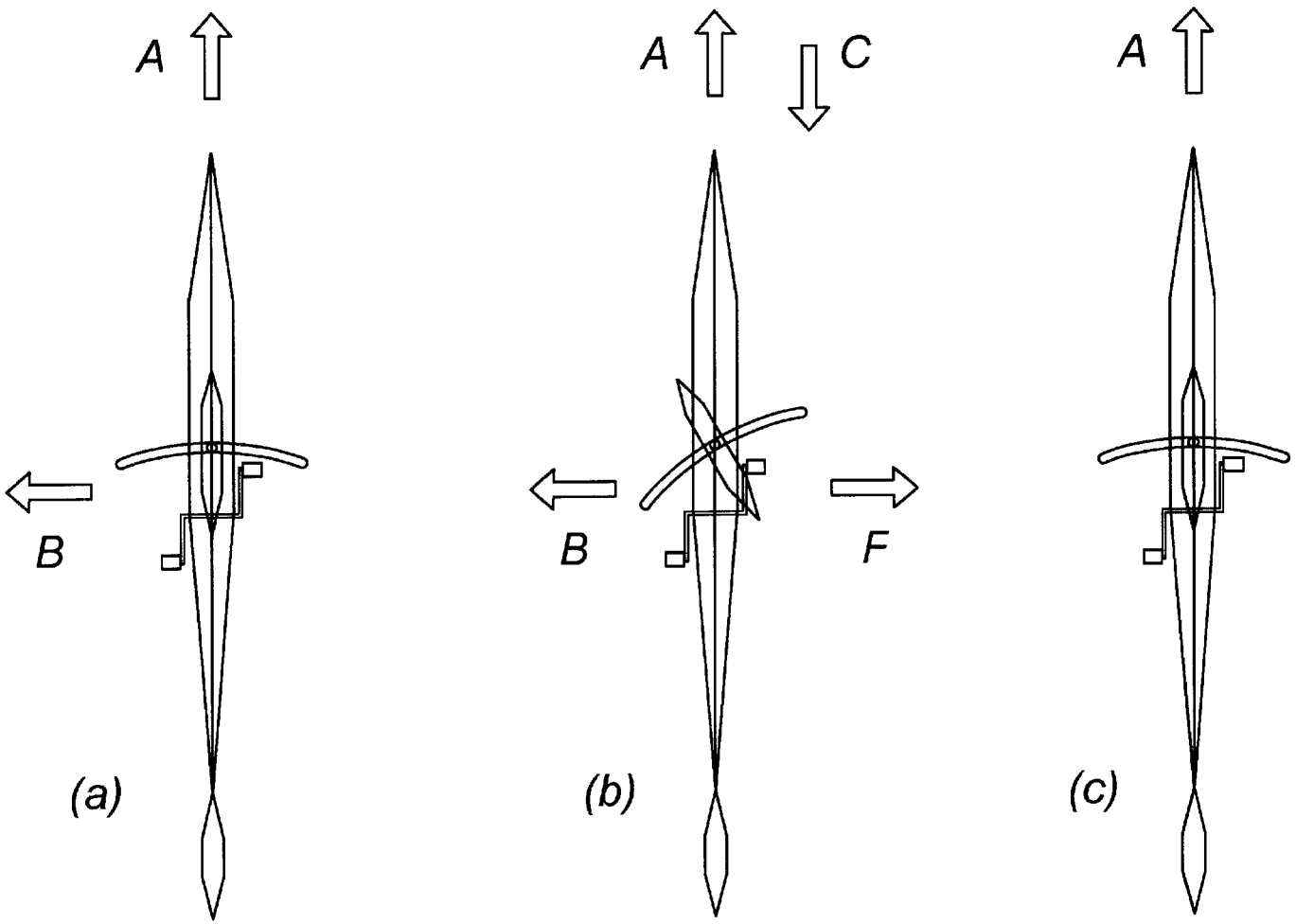
FIG. 2*a* is an illustration of the balancing forces on a canard balanced watercraft.
Figure 2B:
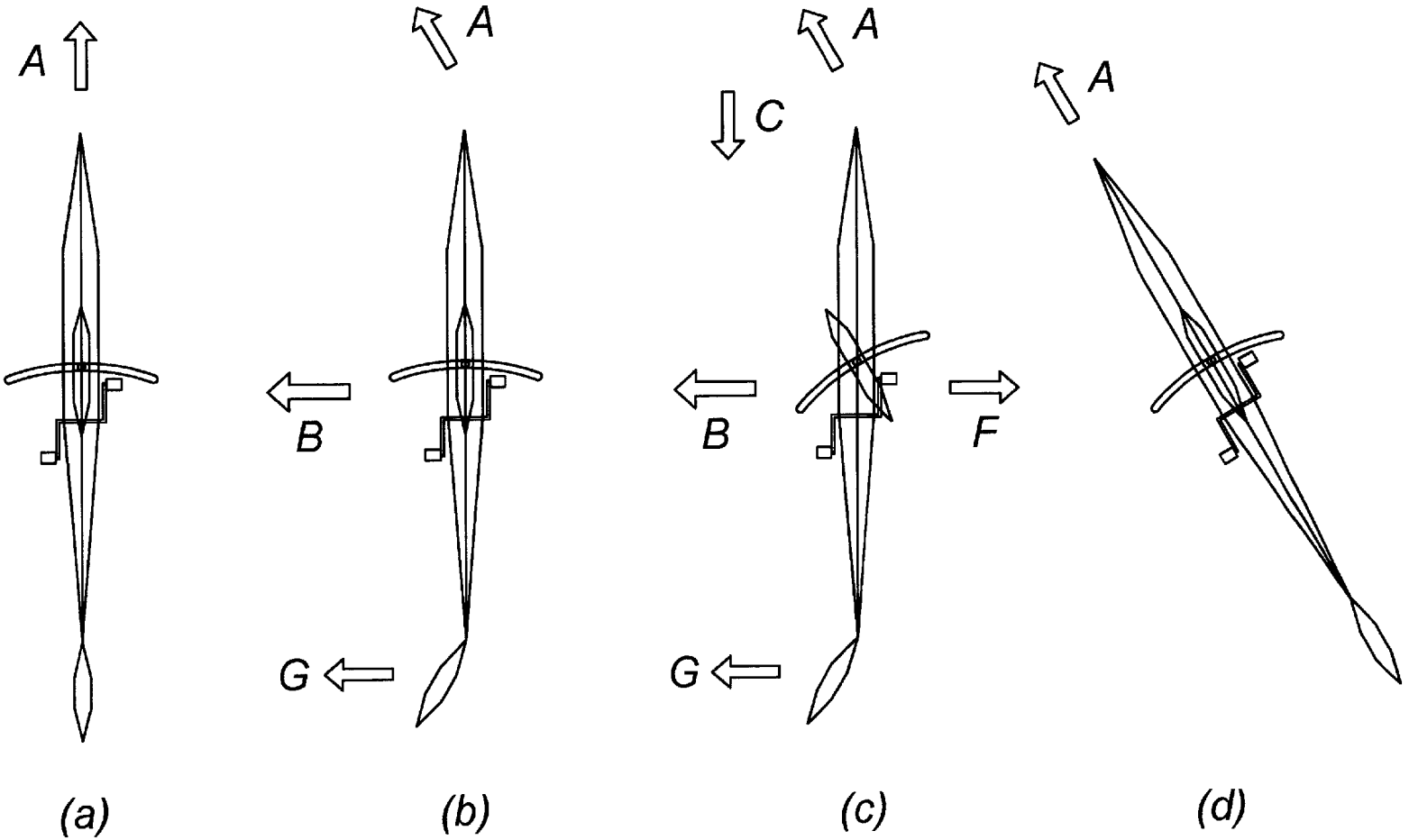
FIG. 2*b* is an illustration of the restoring forces on a canard balanced watercraft.
Figure 3:
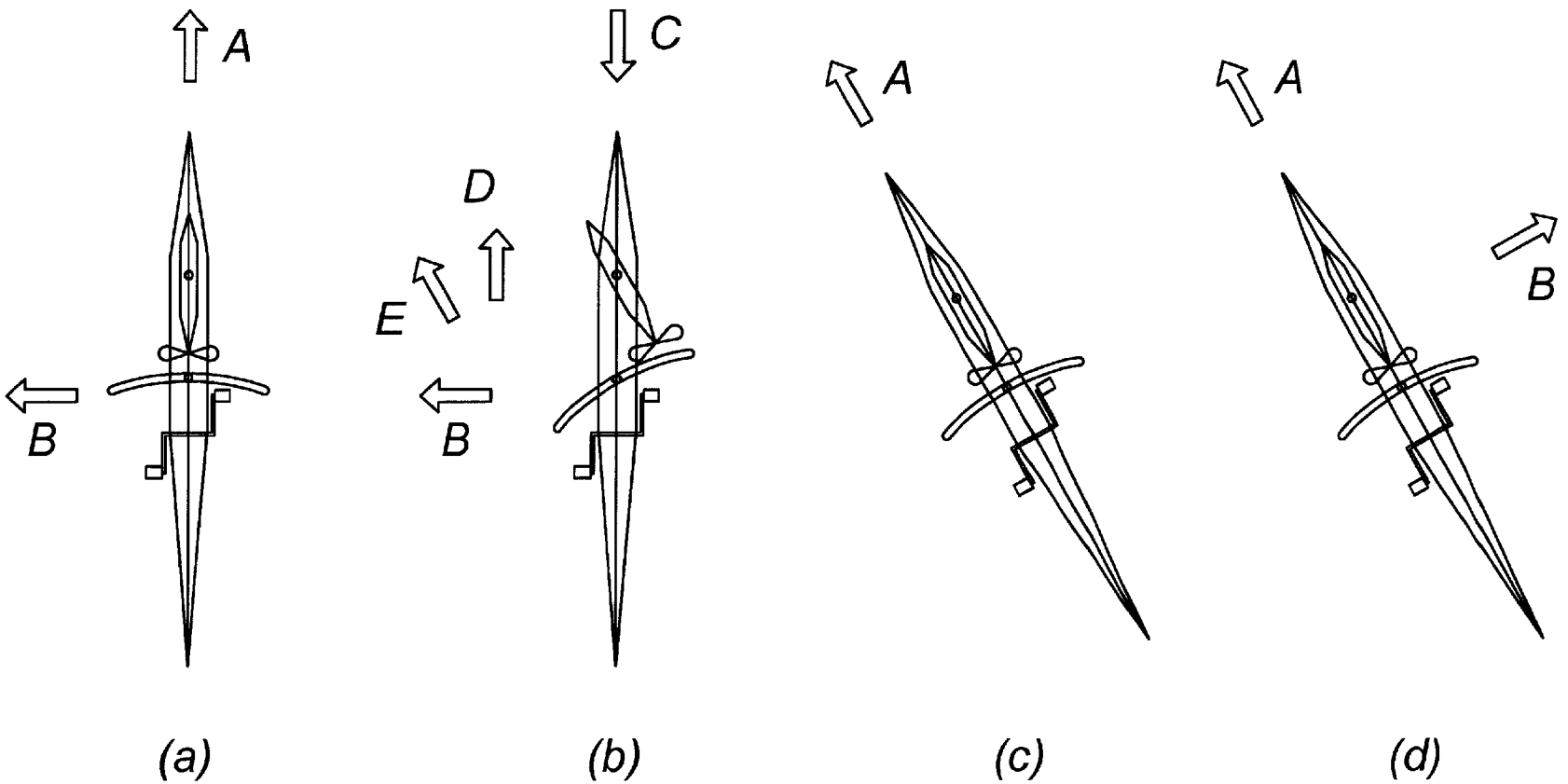
FIG. 3 is an illustration of forces on a bicycle-type marine vessel of the present invention.
Figure 4:
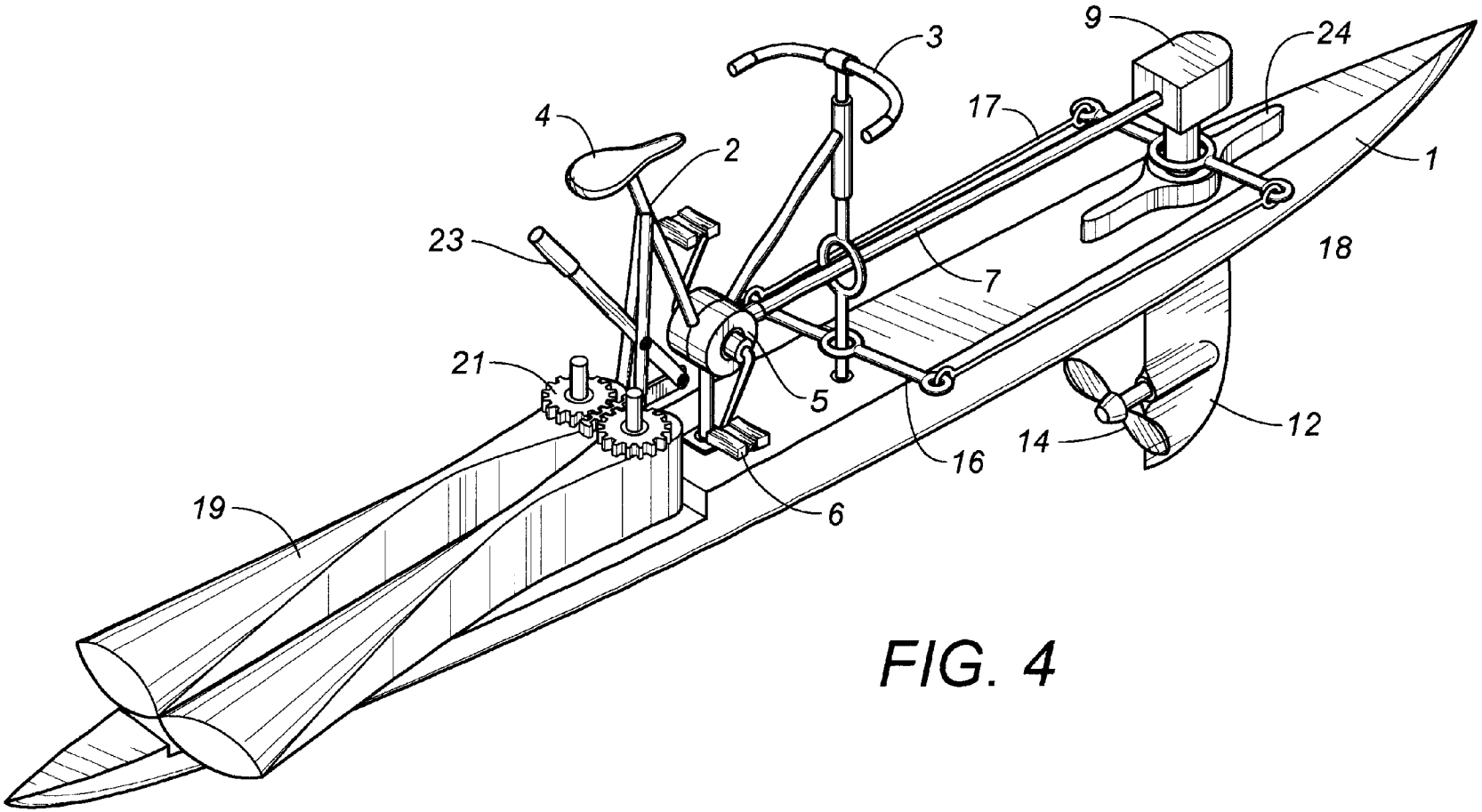
FIG. 4 is a perspective view of the watercraft.
Figure 5:
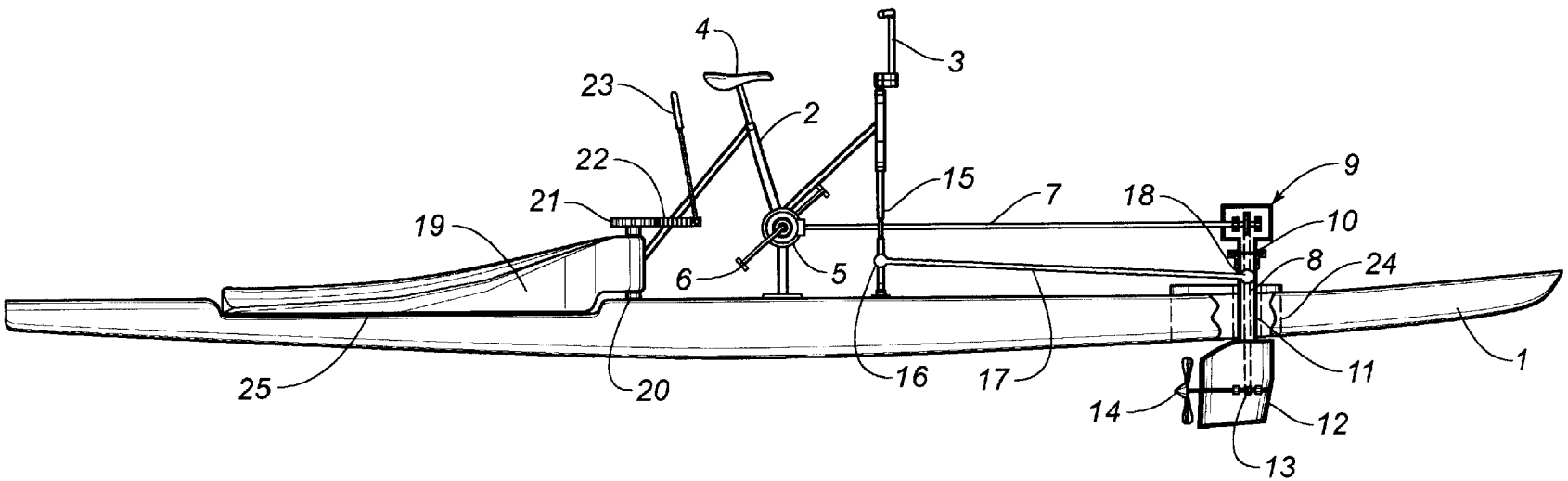
FIG. 5 is a side view of the watercraft.
Figure 6:
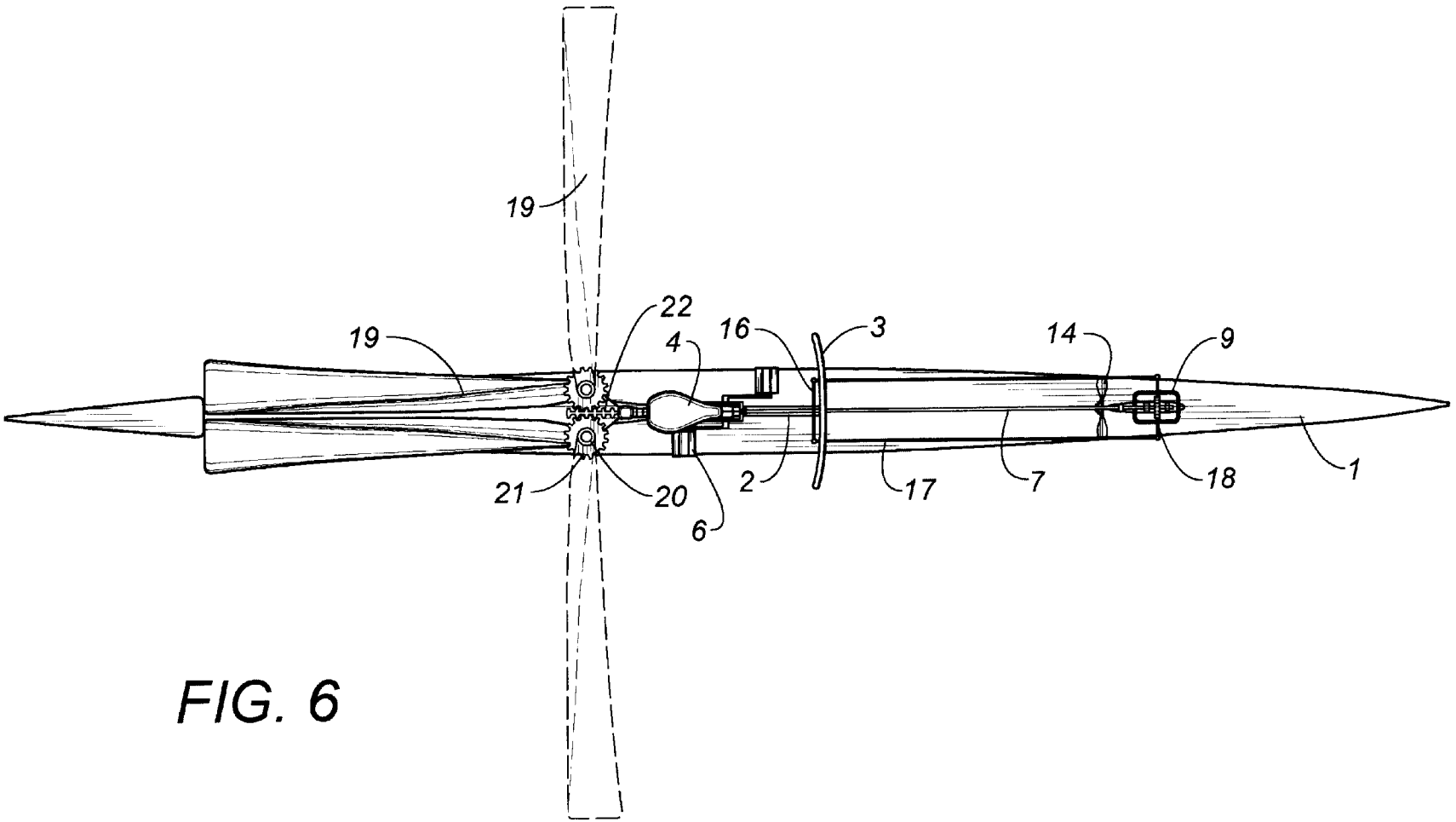
FIG. 6 is an overhead view of the watercraft.
Figure 7:
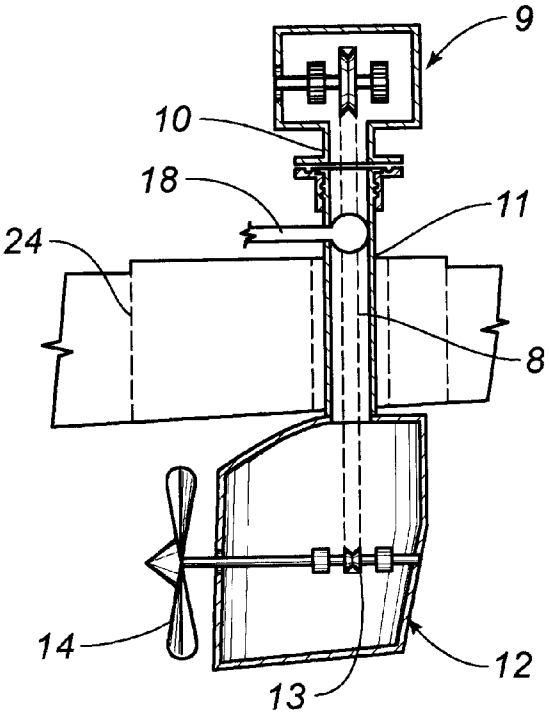
FIG. 7 is a view of the keel-propeller system.

The bicycle-type maring vessel comprises four major parts. The hull (1) that maintains the whole device on float and displaces smoothly over the water, the frame (2) for the rider accommodation, the keel propeller system (9) used for power, balance and direction and finally the deployable floats system (19) used to stay upright while not in motion.

The hull is long, narrow and bottom rounded for minimum wetted surface and maximum hull speed. The bottom section is narrow with minimum draft at bow and stern and wide and deeper in the middle. Fixed to the deck, the aluminum frame (2) is a single piece made of welded tubing pieces with a ground bike type shape where the seat (4), the gear box (5) and the handlebar (3) can be attached so that the seat is slightly behind the pedals (6) with the handlebar (3) forward. The back frame is used to hold the float system support (20).

The drive system starts at the pedal actuated gear box (5) where a shaft (7) is quick coupled horizontally and connects to the keel propeller system at the sealed keel propeller power box (9). Inside the box there is an oil bathed pulley or chain gear that drives the belt or chain (8), whose rotation moves the propeller (14) at the bottom of the keel, through a smaller pulley (13) placed on an axis parallel to the hull axis, supported by suitable bearings or bushings. The belt or chain width and the space inside the keel (12) is such that the whole system can be rotated on a vertical axis to angles close to 90 degrees on either side, while the belt or chain keeps delivering power to the propeller, by means of bushings or bearings acting as guides and allowing the belt or chain to twist close to the midpoint between pulleys. The whole mechanical arrangement of the keel propeller system (9) is sealed and oil filled to avoid salt water penetration and unnecessary maintenance. The keel propeller drive system (9) is attached to the hull by easily disconnectable bolts and is housed in the hull by a keel well (24).The keel well (24) is a longitudinal hole made on the hull (1) sealed on the internal walls that allows the keel propeller system to be inserted or removed without letting water inside the hull. The easy removal of the drive system (9) makes a lighter hull for car top carrying or storage.

The keel (12) is Just as deep as the propeller length to protect the propeller (14) from impact against underwater objects, and is free to rotate altogether with the cylindrical support (11), which rests on the fixed cylindrical support (10). The dynamic joint between both tubes (10) and (11) is achieved with flanges, O-rings and a flexible jacket allowing the lower system section to rotate without leaking while keeping the whole system together. The keel rotation is achieved by connecting the handlebar tube (15) with the keel turning tube (11) with stainless steel cables or aluminum rods (17) attached to the turning arms (16) and (18) on the handlebar tube (15) and the keel tube (11) respectively. The handlebar tube is interrupted by a ring to let the power shaft pass, and continues down to the deck for further support and rigidity.

The float system (19) is made of two floats with each one supported vertically by a long stainless steel bolt (20) attached to the back of the frame (2).

The floats (19) rest on the back deck lowered section (25) just at water level for easy deployment and recovery. The floats (19) are free to rotate about the bolts (20), and their opening position is controlled by horizontal gears (21) placed on top of the bolts (20) that are turned by a dented strap (22) that moves horizontally when a floats lever (23) is displaced by the rider. The floats lever (23) can pivot in the back frame (2) so as to have enough leverage for easy floats positioning.

I claim:

1. A human powered watercraft apparatus comprising:

a single hull having a central longitudinal axis;

a keel pivotally mounted to a bottom of said hull adjacent a forward end of said hull, said keel having a pivot axis extending across said central longitudinal axis of said hull;

a propeller mounted to a shaft extending horizontally through said keel such that propeller rotates adjacent a rear of said keel;

a bicycle frame affixed centrally along said longitudinal axis of said hull, said bicycle frame having a saddle at a top thereof, said bicycle frame having a handlebar pivotally supported thereon, said handlebar being linked to said keel such that a pivoting of said handlebar causes a corresponding pivoting of said keel; and a pedal crank rotatably mounted on said bicycle frame, said pedal crank being linked by a transmission to said shaft of said propeller such that a rotation of said pedal crank causes a corresponding rotation of said propeller.

2. The apparatus of claim 1, said keel having a tubular member affixed thereto and extending upwardly through said hull, said handlebar having a shaft extending downwardly therefrom, said shaft of said handlebar having arms extending transversely outwardly therefrom adjacent a bottom thereof, said arms being coupled by respective parallel rods to said tubular member of said keel.

3. The apparatus of claim 1, said pedal crank being positioned forward of said saddle.

4. The apparatus of claim 1, said transmission comprising:

a shaft coupled by a transmission to said pedal crank such that a rotation of said pedal crank causes said shaft to rotate, said shaft extending along and parallel to said longitudinal axis;

a belt linked to an end of said shaft opposite said pedal crank such that the rotation of said shaft causes a movement of said belt; and a pulley positioned in said keel affixed to said shaft of said propeller, said pulley engaging said belt such that the movement of said belt causes the rotation of said propeller.

5. The apparatus of claim 4, said belt being a chain, said pulley being a sprocket.

6. The apparatus of claim 1, said keel having a tubular member affixed thereto and extending upwardly through said hull, said end of said shaft positioned above a top of said tubular member, said belt extending through said tubular member.

7. The apparatus of claim 1, said keel having an airfoil shape, said shaft of said propeller rotating about an axis parallel to said longitudinal axis.

8. The apparatus of claim 4, said end of said shaft having a pulley thereon with an axis parallel to said longitudinal axis.

9. The apparatus of claim 6, said end of said shaft being positioned a housing, said housing being coupled in liquid-tight relationship to a top of said tubular member, said tubular member being rotatable relative to said housing.

10. The apparatus of claim 1, said keel having a trough formed therein, said keel being affixed within said trough in liquid-tight relationship therewith.

11. The apparatus of claim 1, further comprising:

a pair of arms formed of a polymeric material of a desired buoyancy, said pair of arms being pivotally connected to said hull so as to be deployable in an orientation transverse to said longitudinal axis.

* * * * *